US005391093A

United States Patent [19]

Schlagbaum et al.

[11] Patent Number: 5,391,093

[45] Date of Patent: Feb. 21, 1995

[54] CERAMIC INSULATING BLOCK

[75] Inventors: Peter Schlagbaum, Leinburg; Helmut Stuhler, Nürnberg; Wilfried Krings, Würselen, all of Germany

[73] Assignee: Hoechst CeramTec Aktiengesellschaft, Selb, Germany

[21] Appl. No.: 972,022

[22] Filed: Nov. 9, 1992

[30] Foreign Application Priority Data

Nov. 9, 1991 [DE] Germany ..... 4136868

[51] Int. Cl.[6] ..... H01R 17/00

[52] U.S. Cl. ..... 439/617; 439/747

[58] Field of Search ..... 313/49, 51, 318; 439/617, 618, 746, 747, 733, 734

[56] References Cited

U.S. PATENT DOCUMENTS 1,325,865 12/1919 Shreeve ..... 439/617
4,492,893 1/1985 Steiner et al. ..... 439/618 X
5,222,803 6/1993 Kraus ..... 439/617 X

FOREIGN PATENT DOCUMENTS 938613 10/1948 France .
9006680 8/1990 Germany .

*Primary Examiner*—Khiem Nguyen
*Attorney, Agent, or Firm*—Foley & Lardner

[57] ABSTRACT

In the ceramic insulating block for halogen lamps, which has a shallow channel with a re-entrant projection at its exit side, the insulating block (1) is provided at the entry side (9) of the shallow channel (2) with a recess (10) having a bell-shaped contour. The apex (11) of the recess extends towards the exit side (4) of the shallow channel (2). The recess has an apex height $H_s$ of $\leqq 40\%$, an apex radius $R_s$ of $\leqq 20\%$ of the height H of the insulating block (1) and a base radius $R_B$ of between 140% and 60% of $R_S$.

6 Claims, 2 Drawing Sheets

CERAMIC INSULATING BLOCK

The invention relates to a ceramic insulating block for halogen lamps ($H_1$ lamps) which has a shallow channel having a re-entrant projection at its exit side.

Insulating blocks of the type mentioned are known. They are provided with a shallow channel for receiving the current-carrying contact pin of the halogen lamp. Furthermore, they have bores or depressions on their wide sides which are provided for interlocking connections to a metallic housing which surrounds them. A disadvantage of these insulating blocks is that the insulating block has to be provided with these bores or depressions for the interlocking connections in an additional operation using additional equipment. It is here that the invention aims to provide a remedy.

The object is achieved by an insulating block of the type mentioned, which is provided at the entry side of the shallow channel with a recess having a bell-shaped contour whose apex extends towards the exit side of the shallow channel, the recess having an apex height $H_S$ of $\leqq 40\%$ and an apex radius $R_S$ of $\leqq 20\%$ of the height H of the insulating block, and a base radius $R_B$ of between 140% and 60% of $R_S$.

The flanks of the bell-shaped contour of the recess may include an angle $\alpha$ of between 30° and 80° . At its base, the recess may have the width B of the channel. The rim of the recess may run parallel to the entry plane of the channel and be set back by a distance S of $\leqq 30\%$, referred to the apex height $H_S$, into the interior of the channel from the entry plane and open into the entry plane of the channel at an angle $\beta$ of approximately 45°.

The insulating block according to the invention can be produced without difficulty in one operation. In addition, the green density differences in the insulating block during pressing can be controlled in an advantageous manner so that cracks and excess tolerances can be avoided during firing.

The invention is explained in greater detail by way of example on the basis of drawings depicting only one method of implementation.

In the drawings

Figure 2:
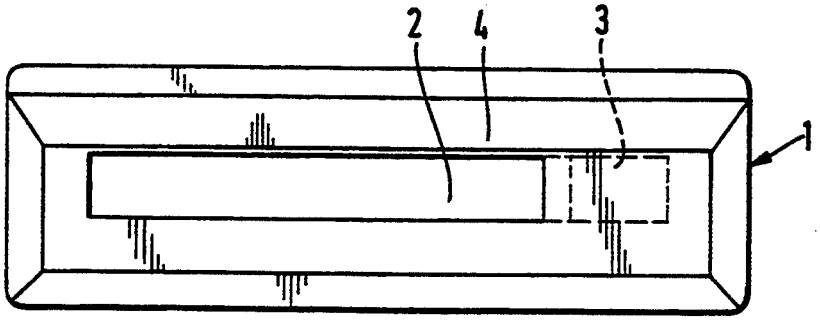
FIG. 2 shows the insulating block in plan view.
Figure 1:
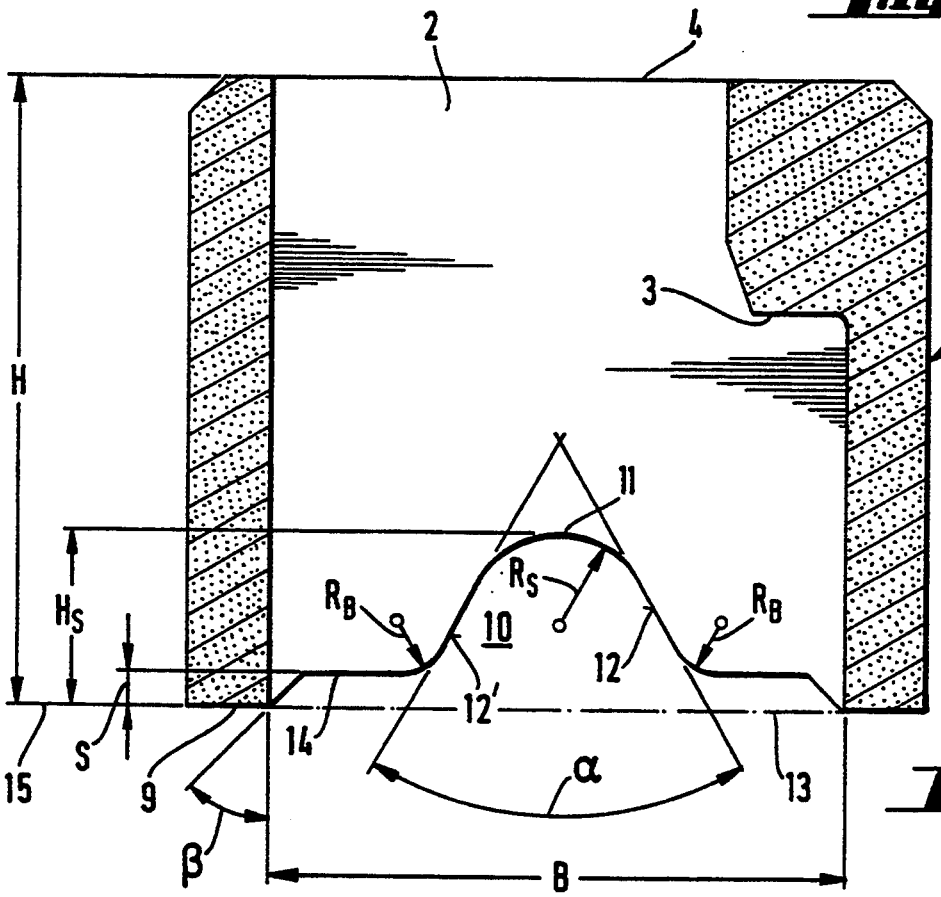
FIG. 1 shows the insulating block sectioned in elevation.
Figure 3:
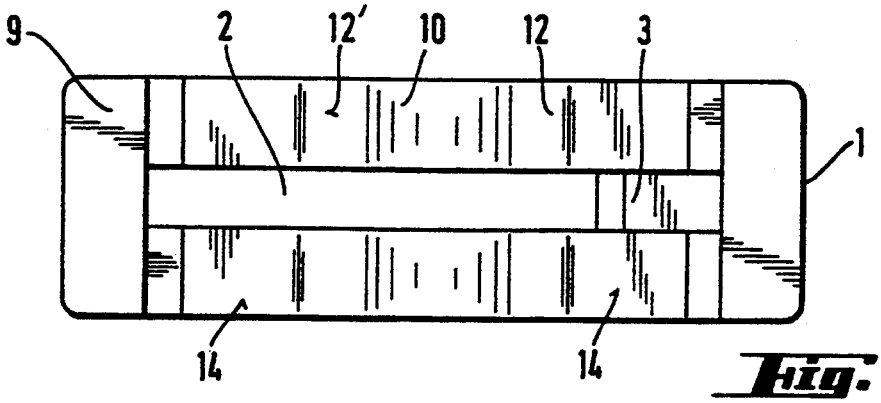
FIG. 3 shows the insulating block from below.
Figure 4:
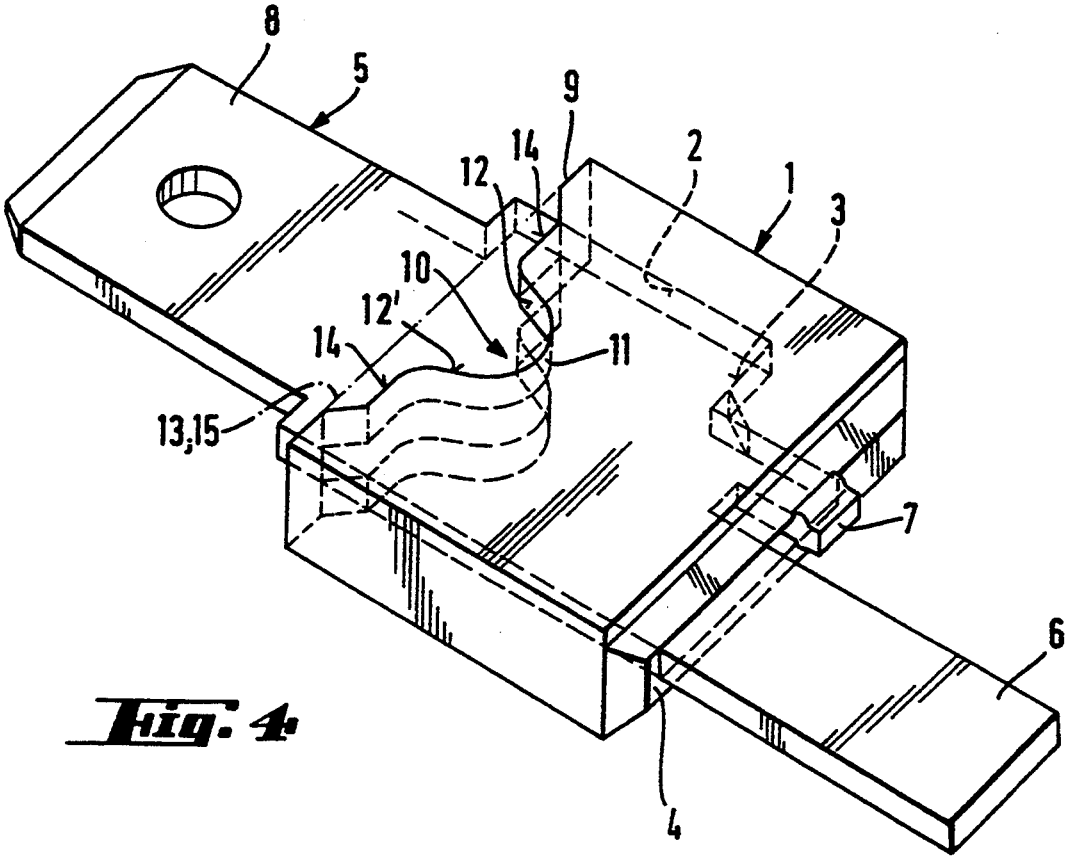
FIG. 4 shows the insulating block with contact pin in perspective.

The ceramic insulating block 1, which can be manufactured preferably from steatite or porcelain, alumina porcelain, mullite material or cordierite material or another ceramic, has in its interior a shallow channel 2 which has a re-entrant projection 3 at its exit side 4. The channel 2 receives the contact pin 5, which has a shoulder (not shown) with which it rests on the re-entrant projection 3. The contact pin 5 has a contact tab 6 for connecting the halogen burner and a lug 7 with which it is secured in the insulating block. The reference numeral 8 indicates the lug for receiving a pole shoe (FIG. 4). At the entry side 9 of the flat channel 2, the insulating block is provided with a recess 10 having a bell-shaped contour whose apex 11 extends towards the exit side 4. The apex height $H_S$ of the recess 10 should be $\leqq 40\%$ and the apex radius $R_S \leqq 20\%$ of the height H of the insulating block 1. The base radius $R_B$ may be 60% to 140% of the apex radius. The flanks 12, 12' of the bell-shaped contour of the recess 10 may include an angle $\alpha$ of between 30° and 80°. The recess 10 may have the width B of the channel 2 at its base 13. The rim 14 of the bell-shaped contour of the recess 10 may extend parallel to the entry plane 15 of the channel 2 and be set back by the distance $S \leqq 30\%$, referred to the apex height $H_S$, into the interior of the channel 2 from the entry plane 15. The rim 14 may open into the entry plane 15 at an angle $\beta$ of preferably approximately 45°. The edge design, as shown in FIG. 2, facilitates the insertion of the insulating block into a metal housing which is not shown.

We claim:

1. A ceramic insulating block having a height H for receiving a contact pin of a halogen lamp, which has a shallow channel having a re-entrant projection at its exit side, which ceramic insulating block is provided, at an entry side of the shallow channel, with a recess having a bell-shaped contour whose apex extends towards an exit side of the shallow channel, the recess having an apex height $H_S$ of $\leqq 40\%$ of the height H of the insulating block, an apex radius $R_S$ of $\leqq 20\%$ of the height H of the insulating block, and a base radius $R_S$ of between 140% and 60% of $R_S$.

2. The ceramic insulating block as claimed in claim 1, wherein the bell-shaped contour of the recess has flanks which include an angle $\alpha$ of between 30° and 80°.

3. The ceramic insulating block as claimed in claim 1, wherein the recess has a width B of the shallow channel at its base.

4. The ceramic insulating block as claimed in claim 1, wherein the bell-shaped contour of the recess has a rim which extends parallel to an entry plane of the shallow channel and is set back by a distance $S \leqq 30\%$, referred to the apex height $R_S$, into the interior of the channel from the entry plane.

5. Use of an insulating block as claimed in claim 1 for receiving current-carrying contact pins of halogen lamps and for making interlocking connections to metallic housings.

6. The ceramic insulating block as claimed in claim 4, wherein the rim opens into the entry plane at an angle $\beta$ of approximately 45°.

* * * * *